US006652113B2

(12) United States Patent
Tant

(10) Patent No.: US 6,652,113 B2
(45) Date of Patent: Nov. 25, 2003

(54) DUAL MODE INDIRECT FLUORESCENT LIGHTING FIXTURE

(76) Inventor: Robert J. Tant, 341 Norumbega Dr., Monrovia, CA (US) 91016-2444

( * ) Notice: Subject to any disclaimer, the term of this patent is extended or adjusted under 35 U.S.C. 154(b) by 0 days.

(21) Appl. No.: 09/967,529

(22) Filed: Oct. 1, 2001

(65) Prior Publication Data

US 2003/0063461 A1 Apr. 3, 2003

(51) Int. Cl.[7] ..... F21V 33/00
(52) U.S. Cl. ..... 362/147; 362/217; 362/346
(58) Field of Search ..... 362/147, 217, 362/222, 223, 224, 261, 297, 298, 346

(56) References Cited

U.S. PATENT DOCUMENTS 1,267,882 A * 5/1918 McFaddin ..... 362/346
4,835,661 A * 5/1989 Fogelberg et al. ..... 362/223
5,134,558 A * 7/1992 Williams et al. ..... 362/298

* cited by examiner

*Primary Examiner*—Y. My Quach-Lee
(74) *Attorney, Agent, or Firm*—J. E. McTaggart

(57) ABSTRACT

A dual-mode light unit, fitting closely against a vertical wall surface, indirectly illuminates a nearby ceiling region with a uniform wash and provides a functional task light component while providing an unusual luminous visual accent effect from a major lower region of the unit. A fluorescent lamp is located about one-third way down from the top of the shallow vertically-elongated enclosure. The lamp is concealed behind a lamp shield running across the front. An upper reflector, offset upwardly from the lamp and extending to the top of the unit, is made with a smooth reflective surface shaped to distribute the upward illumination field from the lamp uniformly as a ceiling wash. A lower luminance panel, offset downwardly from the lamp and extending to the bottom of the unit, a matte surface that picks up highlights from a controlled field of downward illumination from the lamp, creating 14B ' as an unusual soft restful decorative effect while also functioning as a task light.

15 Claims, 6 Drawing Sheets

DUAL MODE INDIRECT FLUORESCENT LIGHTING FIXTURE

FIELD OF THE INVENTION

The present invention relates to the field of electric lighting fixtures and more particularly it relates to a hidden source fluorescent lighting fixture that operates simultaneously in an indirect wash mode in an upward direction and in a modified mode in a downward direction

BACKGROUND OF THE INVENTION

Fluorescent and incandescent lighting fixtures have been made in many variations designed to soften the glare effect of direct lighting by tubes or bulbs, particularly for residential and architectural lighting, generally falling into three categories: shades, diffusers and indirect lighting where the source is in one manner or another hidden from normal view. For fluorescent fixtures, a common example is the external-reflection type of ceiling fixture where the fluorescent tubes are mounted above a decoratively-finished housing to illuminate a room from light that is entirely reflected from a ceiling above the fixture, while concealing the fluorescent tubes from occupants of the room. Another form of indirect fluorescent lighting utilizing internal reflection mounts on or in a wall or ceiling in a manner that conceals the tube(s) but projects a "wash" of light onto a ceiling or wall via a specially-shaped reflector.

OBJECTS OF THE INVENTION

It is a primary object of the present invention to provide a fluorescent light fixture, for mounting externally onto a wall, that will illuminate upwardly with a "wash" effect and simultaneously project special ambient "fill" or "task" illumination downwardly.

It is a further object to provide an easily installed indirect light fixture that will meet a growing demand for glare-free lighting solutions as pertaining to commercial or residential spaces, typically with personal computers or the like.

SUMMARY OF THE INVENTION

The above-mentioned objects have been accomplished in the present invention by providing a shallow vertically elongated housing designed to hang or mount on a wall surface, that contains a curved reflector in an upper portion illuminated by a concealed fluorescent lamp in a mid region of the fixture. A fluorescent lamp co-operates with a first specially shaped reflector that extends upwardly above the fluorescent lamp in an offset shaped to project a "wash" area toward the ceiling.

As the special novel feature of the invention, the downward portion of the light from the lamp illuminates a secondary reflector with a concavely curved surface provided in the lower portion of the fixture beneath the fluorescent tube for an accent effect. This surface can be finished creatively to produce a variety of desired decorative matte effects e.g. a wood grain, metal or other surface that picks up and highlights the downward illumination.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
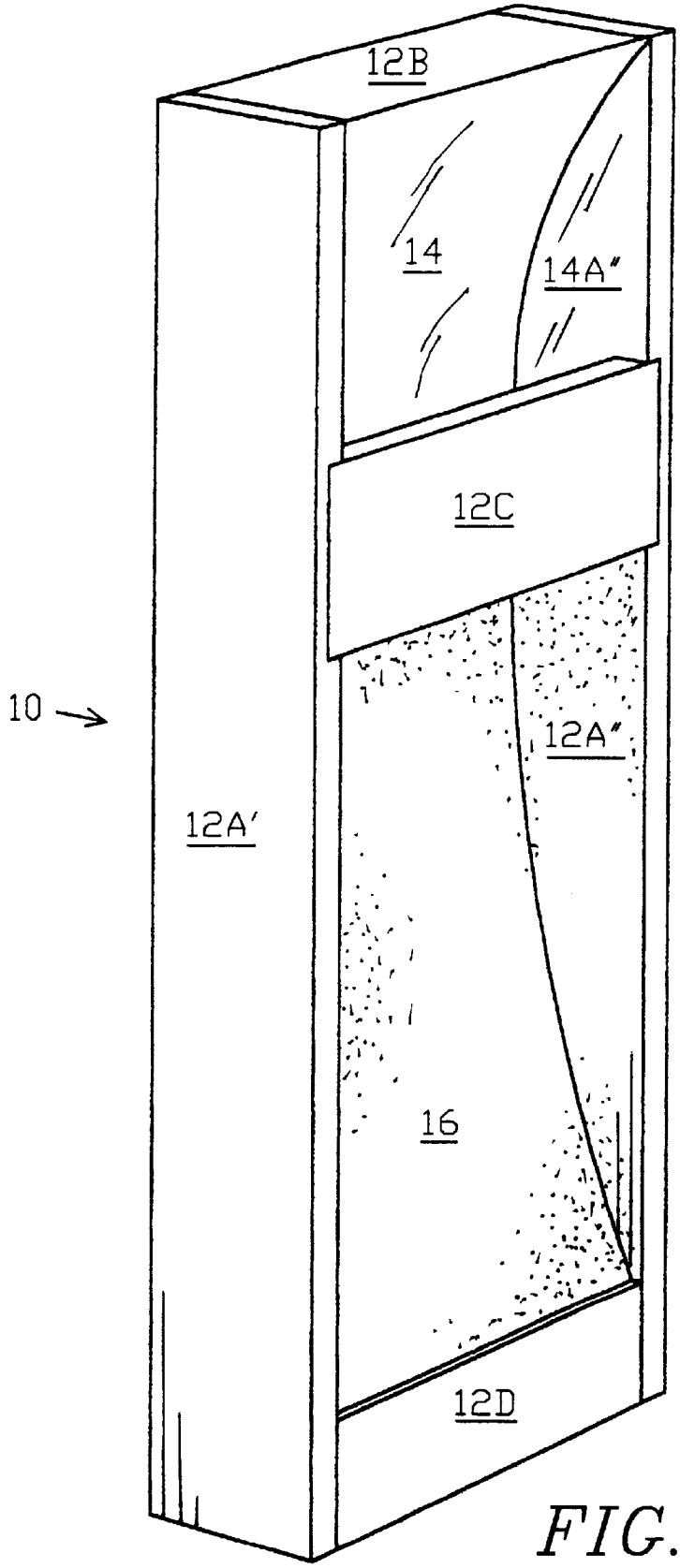
FIG. 1 is a three-dimensional view of a first embodiment of the present invention.

FIG. 1 is a three-dimensional view of a two-mode indirect lighting assembly 10 representing a first embodiment of the present invention. A generally rectangular, vertically elongated enclosure is typically formed from wood panels, including two main side panels 12A' and 12*a*, connected by several transverse components including horizontal top cap 12B, lamp shield 12C, and base block 12D. In the upper region of the enclosure, a curved reflector 14 is made from highly reflective thin sheet metal, typically aluminum, shaped to cast an upward "light wash" effect onto a ceiling region from a compact socket-mounted elongated fluorescent lamp concealed behind lamp shield 12C.

A pair of side panel reflector sheets 14A" (and 14', not visible in this view), of thin reflective sheet metal as in reflector 14, are located on the inside of side panels 12A' and 12A".

In the lower portion of the enclosure, a relatively large curved luminance panel 16, which may be made from wood, metal, plastic, medium density fiberboard or the like, is shaped as shown to curve out to the base block 12D, and is made with a forward-facing surface having a matte or satin finish, rather than a smooth mirror-like finish, and having a light color such as off-white or beige.

A controlled portion of the light from the lamp above reaching luminance panel 16 produces a diffused reflection that serves to create the visual aesthetic impression of a luminous region, and also emits sufficient reflected light to serve as a task light, thus producing overall a soft restful "mood" effect in the lower portion of assembly 10, contrasting with the much different appearance and effect of smooth reflector 14 in the upper portion.

Figure 1A:
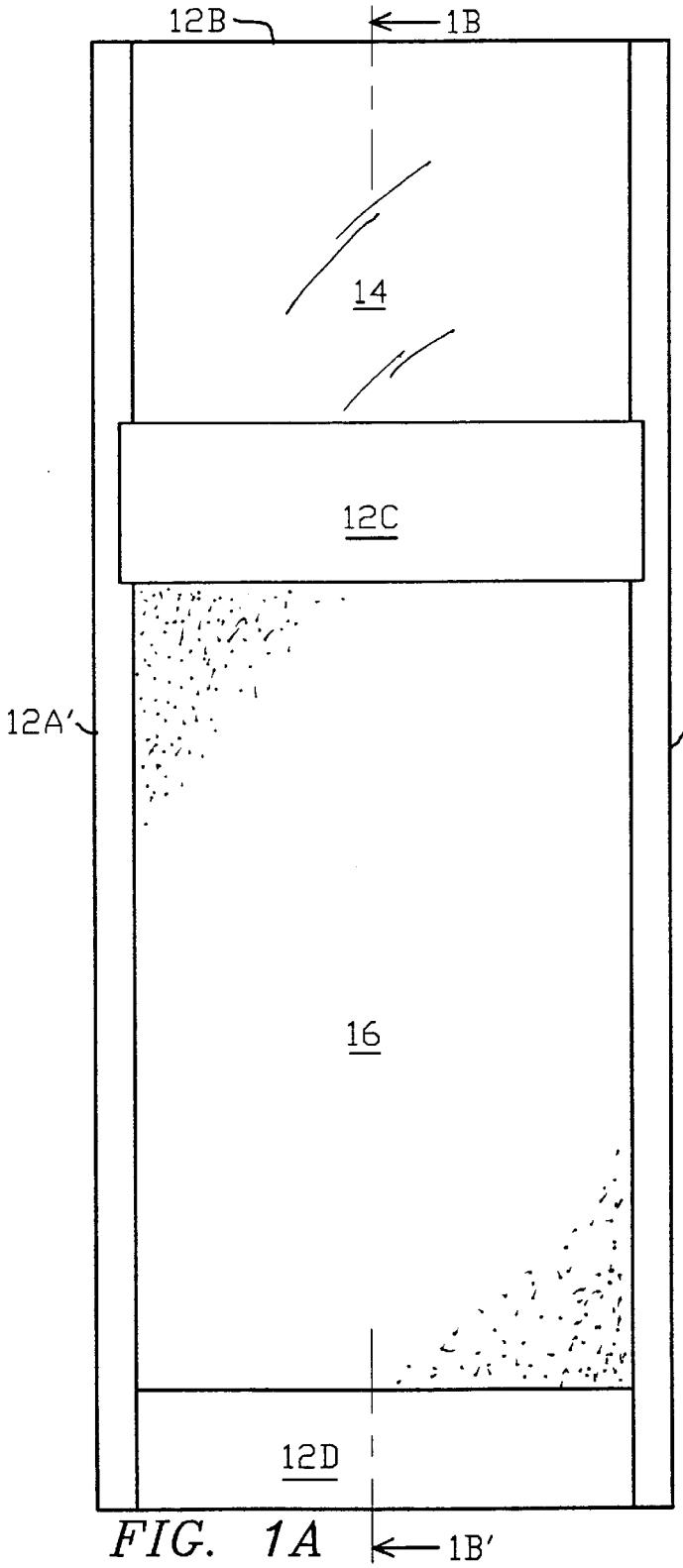
FIG. 1A is an elevational view of the subject matter of FIG. 1.

FIG. 1A is an elevational view of the lighting assembly 10 of FIG. 1, showing the side panels 12A' and 12A", top cap 12B reflector 14, lamp shield 12C, curved luminance panel 16, and baseblock 12D.

Figure 1B:
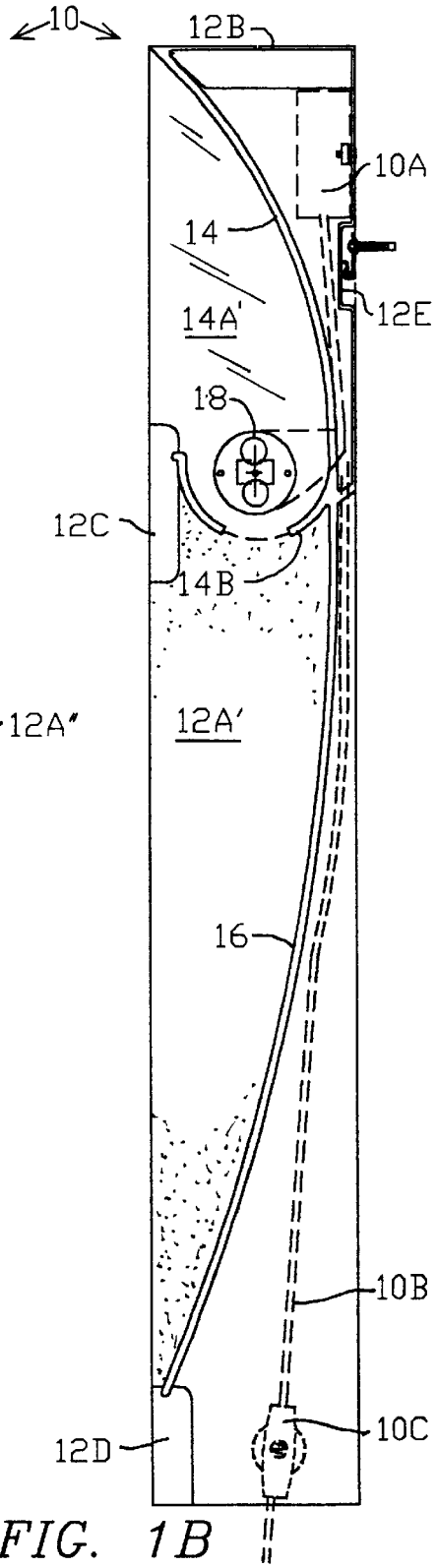
FIG. 1B is a cross-section taken through 1B—1B OF FIG. 1A.

FIG. 1B is a cross-section taken through 1B–1B' of FIG. 1A showing the locations and shapes of reflector 14, a folded style fluorescent lamp 18, lamp shield 12C, curved luminance panel 16, base block 12D and back panel 12E located behind reflector 14C.

Immediately behind lamp shield 12C beneath lamp 18, is a curved reflector 14B which is in effect a continuation of reflector 14, made integral therewith or joined thereto at the rear. Reflector 14B has a highly reflective surface on its top side and serves to contribute to the upward light wash effect from reflector 14, typically directed to nearby ceiling regions. The bottom portion of reflector 14B is configured with a light aperture that allows a controlled amount of light to project downwardly onto luminance panel 16 to provide a special decorative "mood" effect that can be customized by the surface texture of luminance panel 16, e.g. a special grained, textured, matte or satin finish and by the shape, size and pattern of the light aperture(s) configured in reflector 14B: this aperture is typically configured as a single opening dimensioned to confine the direct illumination mainly to the area of luminance panel 16, however there is the option of configuring a pattern of smaller apertures for a special effect.

A ballast 10A for lamp 18 is shown in the top region, and a line cord 10B with an ON-OFF switch 10C are shown in the lower region.

Shield 12C is slotted to support the front flange of a curved reflector 14B beneath lamp 18.

Figure 2:
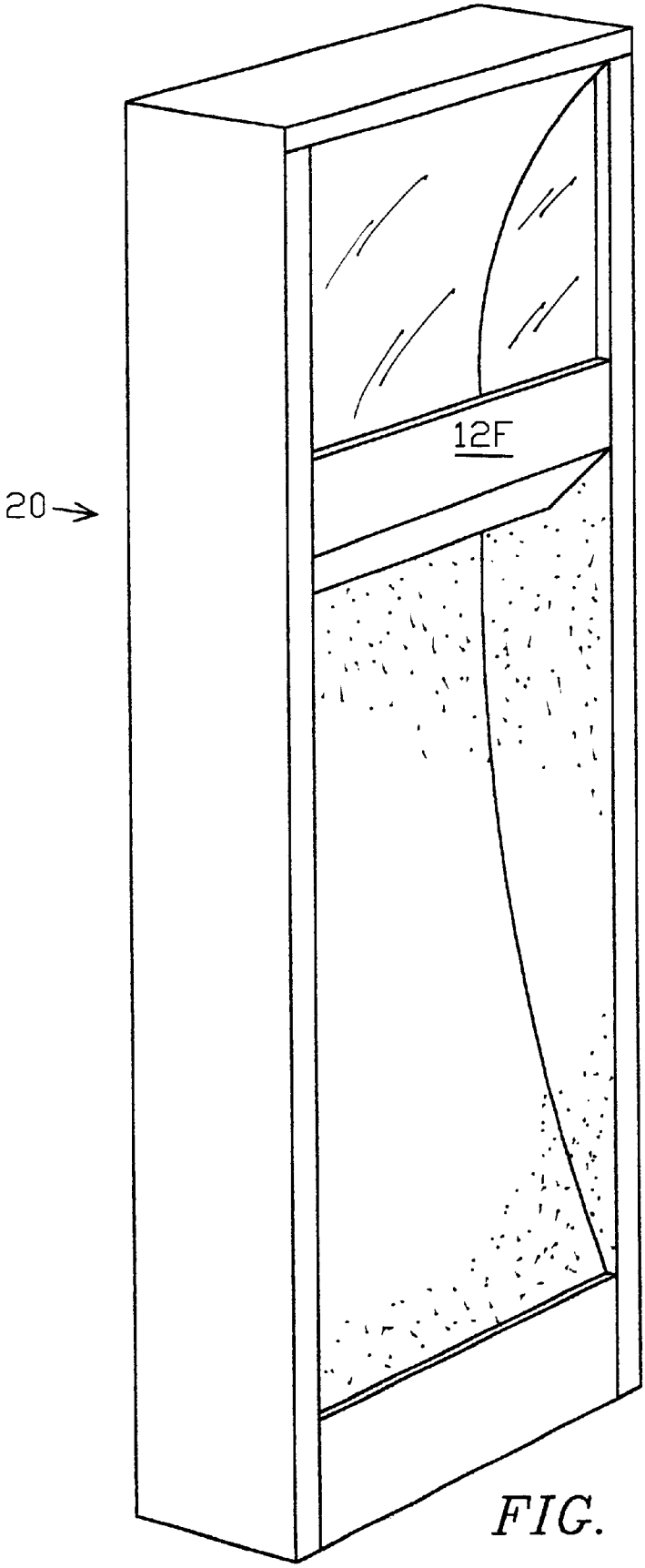
FIG. 2 is a three-dimensional view of a second embodiment of the present invention

A special recessed region is provided in the upper rear metal panel 12E to accommodate hanging hardware for wall attachment FIG. 2 is a three-dimensional view of a second embodiment of the present invention: assembly 20 is generally similar to assembly 10 of FIG. 1, however lamp shield 12F is made from sheet metal rather than wood and has a lower portion bent inwardly as shown.

Figure 2A:
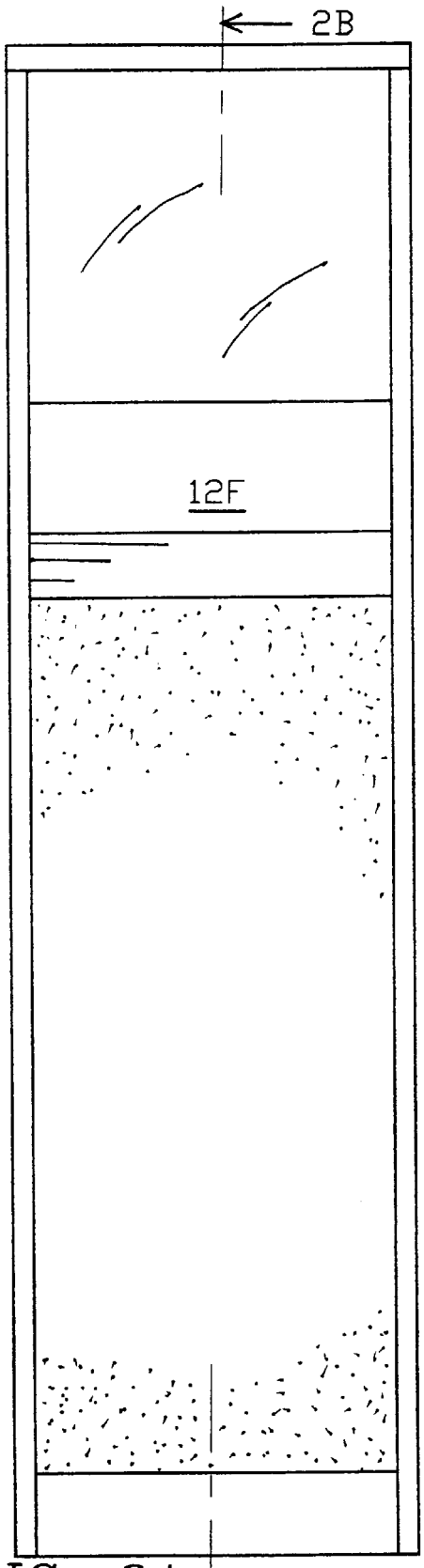
FIG. 2A is an elevational view of a second embodiment of the present invention.

FIG. 2A is a frontal elevation of assembly 20 showing it to appear similar to FIG. 1.

Figure 2B:
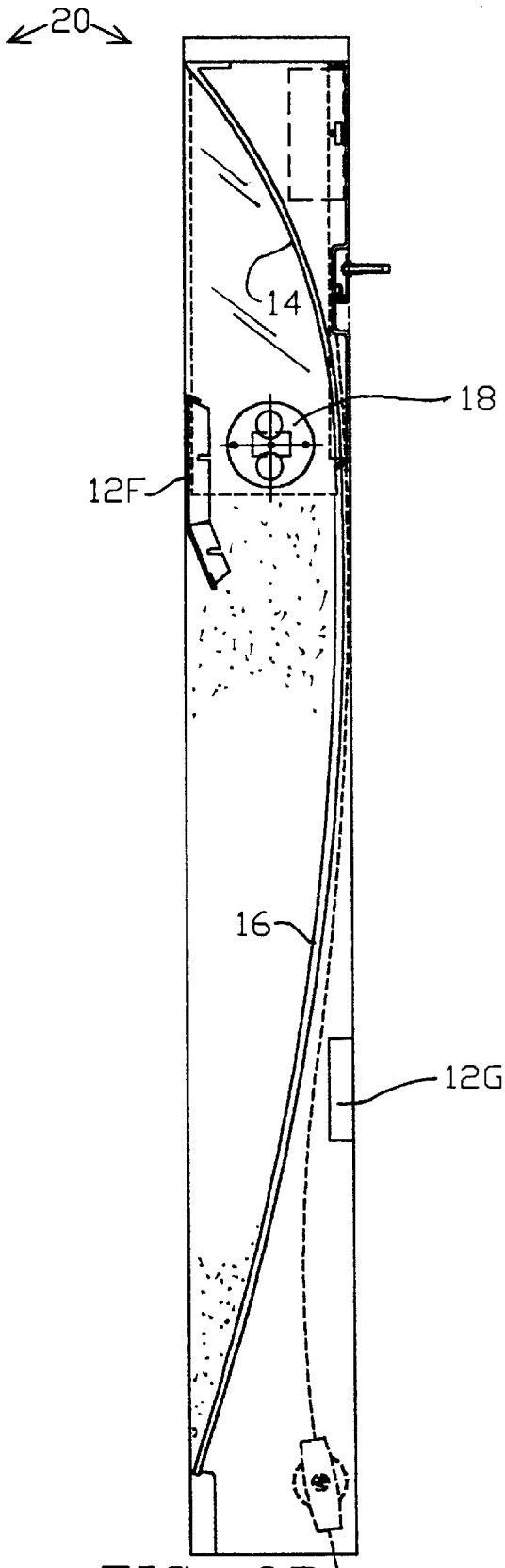
FIG. 2B is a cross-section taken through 2B–2B' of FIG. 2A.

FIG. 2B is a cross-section taken through 2B–2B' of FIG. 2A, showing the cross-sectional shape of sheet metal light shield 12F; the lower bent-back portion acts to control the downward illumination from lamp 18, so that this embodiment does not include a reflector directly beneath the lamp 18, such as that shown above in the first embodiment (auxiliary curved reflector (14B, FIG. 1B).

The structure in FIG. 2B. shows an additional cross-member 12G for enhanced structural integrity of assembly 20.

Figure 3:
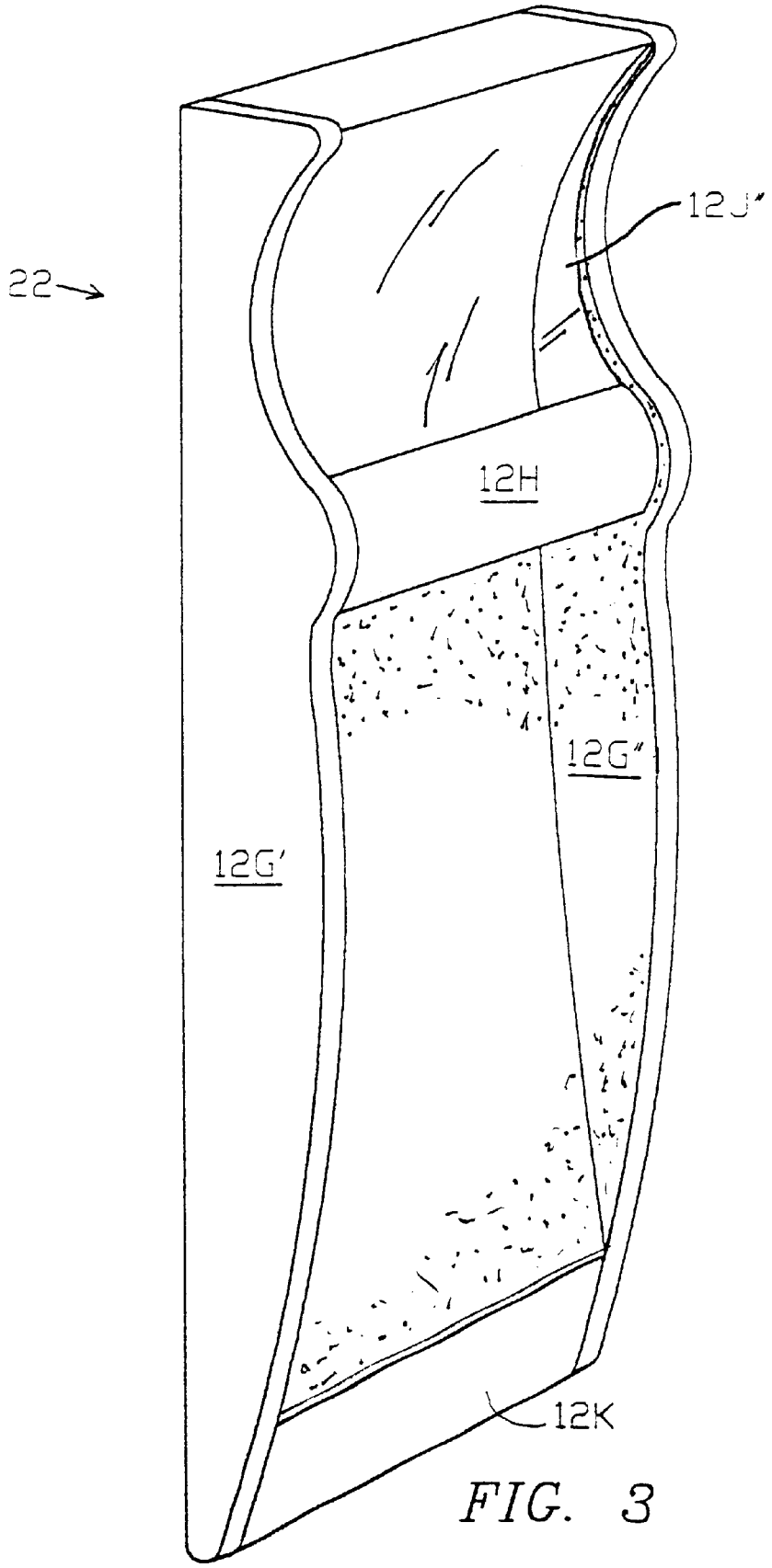
FIG. 3 is a three-dimensional view of a third embodiment of the present invention

FIG. 3 is a three-dimensional view of a third embodiment of the present invention wherein the assembly 22 is configured with the front edges of the two sides 12G' and 12G" contoured as shown to provide a uniqueness that is both decorative and functional, since the contour shape modifies the boundaries of illumination. Lamp shield 12H is configured with a curved shape as shown, and the sides 12G and 12G" are shaped in this region to conform with the curvature of the lamp shield 12H. The base block 12K is inclined to conform with the downwardly-converging shape of the sides 12G' and 12G".

Figure 3A:
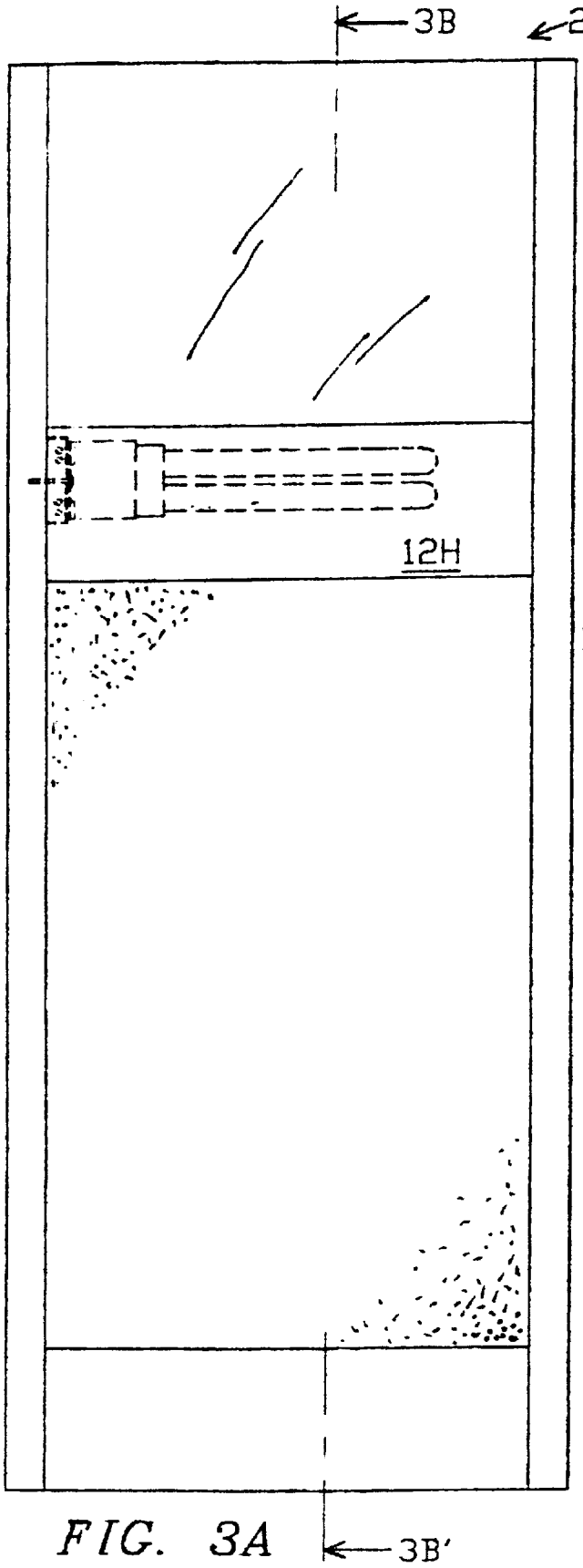
FIG. 3A is an elevational view of the subject matter of FIG. 3.

FIG. 3A is an elevational view of assembly 22 of FIG. 3, showing that, from this viewpoint, this embodiment is generally similar in appearance to the previously described embodiments. The lamp assembly concealed behind lamp shield 12H is shown in dashed lines.

Figure 3B:
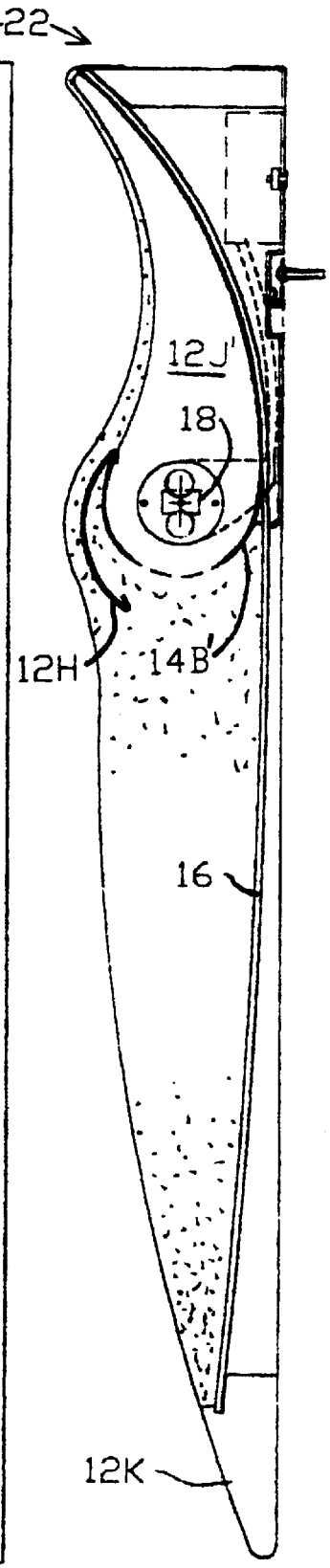
FIG. 3B is a cross-section taken through 3B—3B OF FIG. 3.

FIG. 3B is a cross-section taken through 3B—3B of FIG. 3A. Curved reflector 14B' beneath lamp 18, is similar to curved reflector 14B in FIG. 1B, except that it extends further up at front to the top region of lamp shield 12H, where it receives support. An area 12J' seen at the far sidewall is made with a smooth reflective surface, leaving the tapered border shown along the front edge. Hardware for wall hanging is provided in the upper rear region as shown. A ballast for the lamp 18 may be located behind the upper reflector as shown in dashed lines. Base block 12K is configured with the generally triangular cross section shown with the inclined front surface that conforms to the shape of the two sides, and, as in the other embodiments, there is provided a shallow channel into which the lower edge of luminance panel 16 is inserted, supported and retained.

The general principles of the present invention can be implemented in other equivalent embodiments or variations of the embodiments shown; for example the aspect ratio can be varied from that shown as a matter of design choice.

This invention may be embodied and practiced in other specific forms without departing from the spirit and essential characteristics thereof. The present embodiments therefore are considered in all respects as illustrative and not restrictive. The scope of the invention is indicated by the appended claims rather than by the foregoing description. All variations, substitutions, and changes that come within the meaning and range of equivalency of the claims therefore are intended to be embraced therein.

What is claimed is:

1. A dual-mode indirect light assembly, for mounting on a wall surface, comprising:

a vertically elongated enclosure having a pair of vertical side panels configured with linear rear edges in a vertical plane for close-fitting wall mounting;

a horizontal top cap extending between said side panels at an upper end thereof and defining a linear top front edge;

a lamp shield extending between said side panels located in an upper mid region of said enclosure in a vertical front plane thereof;

an elongated lamp installed behind said lamp shield;

a reflector, having a concave curved shape as viewed in a vertical plane, located in an upper region of said enclosure, extending linearly and uniformly between said side panels and extending from the front edge of said horizontal top cap to a rearward mid-region of said enclosure behind said lamp;

a luminance panel with a forward-facing matte surface, located in a lower region of said enclosure: and downward light control means disposed in the lower region of said enclosure, made and arranged to allow and control light from said lamp to produce luminance on the matte surface of said luminance panel.

2. The dual-mode indirect light assembly as defined in claim 1 wherein said luminance panel is made and arranged to extend between said side panels and to have a cross-sectional surface shape, viewed in the vertical plane, extending downwardly in an inclined direction from a top edge located in the rearward mid-region of said enclosure to a bottom edge located more forwardly in the lower region of said enclosure.

3. The dual-mode indirect light assembly as defined in claim 1 wherein said reflector is configured with a smooth forward-facing reflective surface made to have a cross-sectional concave curved shape that causes said lamp to project a predetermined upper field of indirect illumination onto a nearby overhead ceiling.

4. The dual-mode indirect light assembly as defined in claim 3 wherein the cross-sectional shape of the forward reflective surface of said reflector is made to have a varying radius of curvature that increases continuously from bottom to top.

5. The dual-mode indirect light assembly as defined in claim 1 wherein the forward-facing matte surface of said luminance panel is configured with a concave curved cross-sectional shape as viewed in the vertical plane.

6. The dual-mode indirect light assembly as defined in claim 5 wherein the concave curved cross-sectional shape of the forward surface of the luminance panel is made to have a varying radius of curvature that increases continuously from top to bottom.

7. The dual-mode indirect light assembly as defined in claim 1 wherein said downward light control means is made and arranged to control downward distribution of light from said lamp in a manner to produce a region of task light luminance upon said luminance panel and thus provide a diffused visual effect in the lower region that differs substantially from that perceived at said reflector in the upper region, thus producing an overall lighting effect of architectural quality.

8. The dual-mode indirect light assembly as defined in claim 7 wherein said downward light control means comprises a baffle extending rearwardly from a lower region of said light shield to an extent that produces a desired distribution of luminance.

9. The dual-mode indirect light assembly as defined in claim 8 wherein said baffle is made from sheet metal as an integral extension of said light shield and formed to extend rearwardly at an obtuse angle to serve as said downward light control means.

10. The dual-mode indirect light assembly as defined in claim 1 wherein said downward light control means is made and arranged to direct light from said lamp in a manner to produce a predetermined distribution pattern of luminance over at least a predetermined portion of the forward-facing surface of said luminance panel.

11. The dual-mode indirect light assembly as defined in claim 10 wherein said downward light control means comprises a light mask located generally beneath said lamp and configured with at least one aperture made and arranged to confine downward light from said lamp in a manner to produce the distribution pattern of luminance upon said luminance panel.

12. The dual-mode indirect light assembly as defined in claim 11 wherein said light mask is made from sheet metal with a smooth reflective upward-facing surface.

13. The dual-mode indirect light assembly as defined in claim 12 wherein said light mask is made as an integral extension of said reflector in the upper region.

14. The dual-mode indirect light assembly as defined in claim 1 further comprising a recessed rear region made and arranged to accommodate wall mounting hardware in a manner to enable the rear edges of said panels to mount flush against a host wall.

15. The dual-mode indirect light assembly as defined in claim 1 wherein:

said side panels are configured with front edges thereof shaped in compound curvature including convex curvature in a region that includes said light shield; and said light shield is configured to have a cross-sectional shape that defines a front surface curvature that is made to conform uniformly to the convex curvature of said side panels.

* * * * *